US010533551B2

(12) United States Patent
Kim et al.

(10) Patent No.: US 10,533,551 B2
(45) Date of Patent: Jan. 14, 2020

(54) SCROLL COMPRESSOR HAVING WRAP WITH REINFORCING PORTION

(71) Applicant: LG ELECTRONICS INC., Seoul (KR)

(72) Inventors: Cheolhwan Kim, Seoul (KR); Yongkyu Choi, Seoul (KR); Taekyoung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 184 days.

(21) Appl. No.: 15/491,023

(22) Filed: Apr. 19, 2017

(65) Prior Publication Data

US 2017/0306954 A1 Oct. 26, 2017

(30) Foreign Application Priority Data

Apr. 26, 2016 (KR) ..... 10-2016-0051043

(51) Int. Cl.
*F04C 18/02* (2006.01)
*F01C 21/10* (2006.01)

(52) U.S. Cl.
CPC ..... *F04C 18/0269* (2013.01); *F04C 18/0215* (2013.01)

(58) Field of Classification Search
CPC ..... F04C 18/0269; F04C 18/0215; F04C 18/0246; F01C 21/102
See application file for complete search history.

(56) References Cited

U.S. PATENT DOCUMENTS 5,318,424 A * 6/1994 Bush ..... F04C 18/0269 418/150
5,413,469 A * 5/1995 Nakajima ..... F04C 29/0021 384/123

(Continued)

FOREIGN PATENT DOCUMENTS

CN 101395377 3/2009
CN 103814218 5/2014

(Continued)

OTHER PUBLICATIONS

Chinese Office Action dated Sep. 27, 2018 issued in Application No. 201710236347.X (with English Translation).

(Continued)

*Primary Examiner* — Deming Wan
(74) *Attorney, Agent, or Firm* — Ked & Associates LLP

(57) ABSTRACT

A scroll compressor is provided that may include an orbiting scroll having an orbiting wrap, and which performs an orbiting motion; and a fixed scroll having a fixed wrap to form a compression chamber including a suction chamber, an intermediate pressure chamber, and a discharge chamber, by being engaged with the orbiting wrap. A wrap thickness of the fixed wrap may be greater than a wrap thickness of the orbiting wrap within a range which forms the suction chamber. With such a configuration, even if the fixed scroll or the orbiting scroll is thermally-expanded, a transformation of the fixed wrap at a suction side may be prevented. This may prevent a gap between the fixed wrap and the orbiting wrap at an opposite side to the suction side, thereby enhancing compression efficiency.

17 Claims, 12 Drawing Sheets

(56) References Cited

U.S. PATENT DOCUMENTS

| | | | | |
|---|---|---|---|---|
| 5,591,022 | A * | 1/1997 | Protos | F01C 17/00 418/55.2 |
| 5,938,417 | A * | 8/1999 | Takao | F04C 18/0269 418/55.2 |
| 6,213,741 | B1 | 4/2001 | Mori et al. | |
| 9,163,632 | B2 * | 10/2015 | Katou et al. | F04C 18/0215 418/55.2 |
| 2004/0067147 | A1 | 4/2004 | Nakane et al. | |
| 2004/0101428 | A1 | 5/2004 | Shibamoto et al. | |
| 2006/0115371 | A1 * | 6/2006 | Hiwata | F04C 18/0215 418/55.2 |
| 2015/0369244 | A1 | 12/2015 | Stoop et al. | |
| 2016/0053759 | A1 | 2/2016 | Choi et al. | |
| 2019/0072092 | A1 * | 3/2019 | Kim et al. | F04C 18/0215 |

FOREIGN PATENT DOCUMENTS

| | | |
|---|---|---|
| CN | 105264231 | 1/2016 |
| CN | 105370571 | 3/2016 |
| EP | 0 275 415 | 7/1988 |
| EP | 2 143 950 | 1/2010 |
| GB | 2 200 408 | 8/1988 |
| JP | 8-4669 | 1/1996 |
| JP | 2971739 | 11/1999 |
| JP | 2001-020878 | 1/2001 |
| JP | 2007-278271 | 10/2007 |
| JP | 2008-463895 | 7/2008 |
| JP | 2009-174406 | 8/2009 |
| JP | 2010-248994 | 11/2010 |
| JP | 2010-248995 | 11/2010 |
| KR | 10-2014-0063830 | 5/2014 |
| KR | 10-2014-0144032 | 12/2014 |
| KR | 10-2016-0022146 | 2/2016 |

OTHER PUBLICATIONS

Extended European Search Report dated Oct. 6, 2017 issued in Application No. 17166246.3.
International Search Report dated Jun. 9, 2017.
European Search Report dated Aug. 4, 2017 issued in Application No. 17165725.7.
Chinese Office Action dated Jul. 31, 2018 (English Translation).
International Search Report dated Jun. 7, 2017.
U.S. Office Action issued in U.S. Appl. No. 15/491,051 dated Mar. 28, 2019.
U.S. Appl. No. 15/491,051, filed Apr. 19, 2017.
Chinese Office Action dated Jun. 19, 2019 with English Translation.
U.S. Notice of Allowance issued in U.S. Appl. No. 15/491,051 dated Sep. 20, 2019.

* cited by examiner

SCROLL COMPRESSOR HAVING WRAP WITH REINFORCING PORTION

CROSS-REFERENCE TO RELATED APPLICATION(S)

Pursuant to 35 U.S.C. § 119(a), this application claims the benefit of an earlier filing date of and the right of priority to Korean Application No. 10-2016-0051043, filed on Apr. 26, 2016, the contents of which are incorporated by reference herein in its entirety.

BACKGROUND

1. Field

A scroll compressor is disclosed herein.

2. Background

Generally, a scroll compressor is being widely used in air conditioners, for example, in order to compress a refrigerant, owing to its advantages that a compression ratio is relatively higher than that of other types of compressors, and a stable torque is obtainable as processes for suction, compressing, and discharging a refrigerant are smoothly performed. A behavior characteristic of the scroll compressor is determined by a non-orbiting wrap (hereinafter, referred to as a "fixed wrap") of a non-orbiting scroll (hereinafter, referred to as a "fixed scroll") and an orbiting wrap of an orbiting scroll. The fixed wrap and the orbiting wrap may have any shape, but they generally have a shape of an involute curve for easy processing. The involute curve means a curved line corresponding to a moving path drawn by the end of a thread when the thread wound around a basic circle having any radius is unwound. In a case of using such an involute curve, the fixed wrap and the orbiting wrap stably perform a relative motion since they have a constant thickness, thereby forming a compression chamber to compress a refrigerant.

As a volume of the compression chamber of the scroll compressor is decreased towards an inner side from an outer side, a suction chamber is formed at the outer side and a discharge chamber is formed at the inner side. A refrigerant suctioned into the suction chamber has a temperature of about 18° C., and a refrigerant discharged from the discharge chamber has a temperature of about 80° C. However, the orbiting scroll is not greatly influenced by a refrigerant discharge temperature, as a rear surface thereof is positioned between the orbiting scroll and the fixed scroll in a supported state by a main frame. On the other hand, the fixed scroll is exposed to a refrigerant discharge temperature as a plate portion or plate, which forms a rear surface thereof is coupled to an inner space of a casing or a discharge cover or a high and low pressure separation plate.

As the rear surface of the fixed scroll is exposed to a refrigerant discharge temperature, the plate portion of the fixed scroll is entirely influenced by the refrigerant discharge temperature to be thermally-expanded. On the other hand, a fixed wrap, provided on one side surface of the plate portion of the fixed scroll and forming the compression chamber, is not entirely influenced by a refrigerant discharge temperature. More specifically, a part or portion of the fixed wrap near a suction chamber is influenced by a suction temperature, a part or portion of the fixed wrap near an intermediate pressure chamber is influenced by an intermediate compression temperature, and a part or portion of the fixed wrap near a discharge chamber is influenced by a discharge temperature. That is, the fixed wrap has a different thermal expansion rate according to a region. As the plate portion of the fixed scroll is more thermally-transformed than the fixed wrap, the fixed wrap is transformed in a contracted shape.

Especially, as the fixed wrap near the suction chamber directly contacts a cold suction refrigerant having a temperature of about 18° C., the fixed wrap near the suction chamber is more transformed than other regions, because it has a tendency to be contracted towards a central region. This may cause an orbiting wrap contacting the fixed wrap formed near the suction chamber, to be pushed by the bent fixed wrap. As a result, the orbiting wrap having a crank angle of 180° at an opposite side is spaced from the fixed wrap, resulting in a compression loss.

Further, as a specific region of the fixed wrap is more thermally-transformed than other regions, the fixed wrap and the orbiting wrap may excessively contact each other. This may increase a frictional loss or abrasion between the fixed scroll and the orbiting scroll.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a scroll compressor according to embodiments will be explained in more detail with reference to the attached drawings. For reference, the scroll compressor according to embodiments is to prevent interference between a fixed wrap and an orbiting wrap at a region near a suction chamber, due to a non-uniform thermal transformation of a fixed scroll, by forming a wrap thickness of the fixed wrap near the suction chamber to be large. Thus, the embodiments may be applied to any type of scroll compressor having a fixed wrap and an orbiting wrap. However, for convenience, a lower compression type scroll compressor where a compression part or device is disposed below a motor part or motor, more specifically, a scroll compressor where a rotational shaft is overlapped with an orbiting wrap on a same plane will be explained. Such a scroll compressor is appropriate to be applied to a refrigerating cycle of a high temperature and a high compression ratio.

Figure 1:
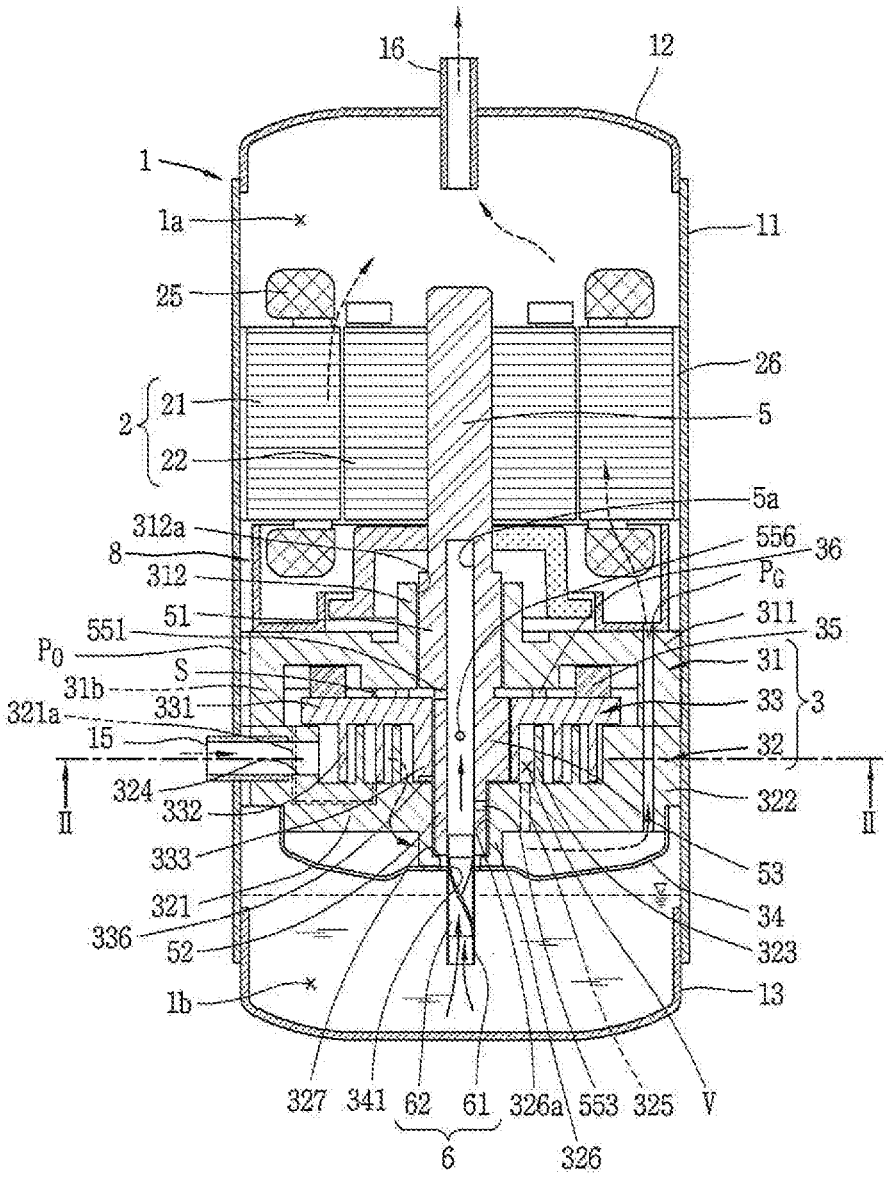
FIG. 1 is a longitudinal cross-sectional view illustrating an example of a lower compression type scroll compressor according an embodiment.
Figure 2:
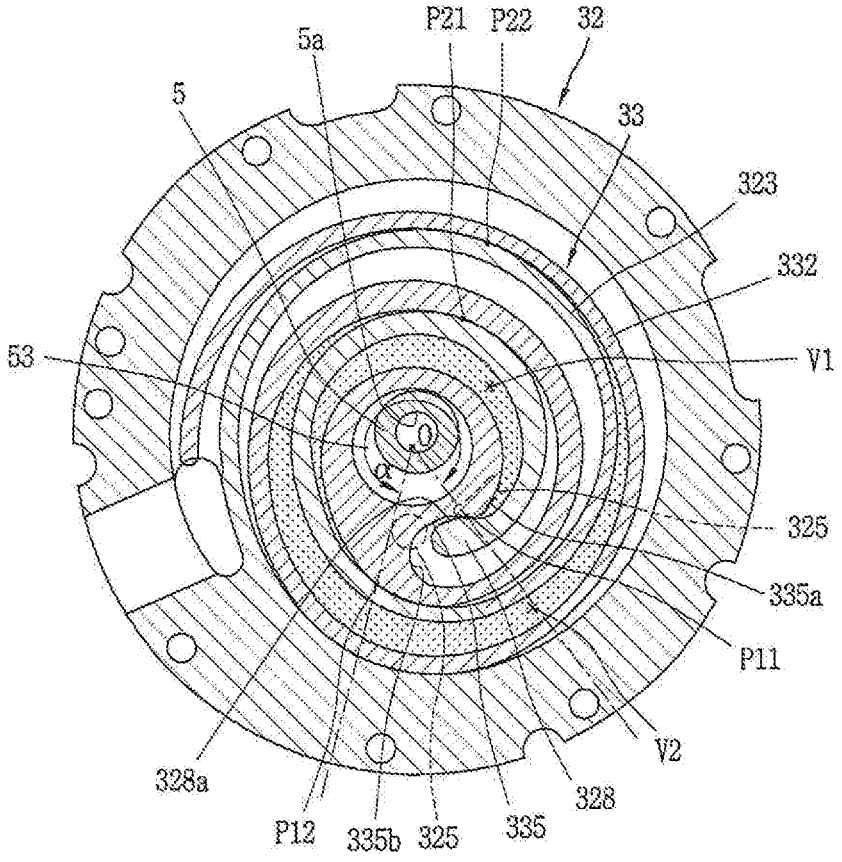
FIG. 2 is a sectional view taken along line 'II-II' in FIG. 1.

FIG. 1 is a longitudinal sectional view illustrating an example of a lower compression type scroll compressor according to an embodiment. FIG. 2 is a sectional view taken along line 'II-II' in FIG. 1.

Referring to FIG. 1, the lower compression type scroll compressor according to this embodiment may include a casing 1 having an inner space 1*a*; a motor part or motor 2 provided at the inner space 1*a* of the casing 1 and configured to generate a rotational force, in the form of a drive motor, a compression part or device 3 disposed or provided below the motor part 2, and configured to compress a refrigerant by receiving the rotational force of the motor part 2. The casing 1 may include a cylindrical shell 11 which forms a hermetic container; an upper shell 12 which forms the hermetic container together by covering an upper part or portion of the cylindrical shell 11; and a lower shell 13 which forms the hermetic container together by covering a lower part or portion of the cylindrical shell 11, and which forms an oil storage space 1*b*.

A refrigerant suction pipe 15 may be penetratingly-formed at a side surface of the cylindrical shell 11, thereby directly communicating with a suction chamber of the compression part 3. A refrigerant discharge pipe 16 that communicates with the inner space 1*a* of the casing 1 may be installed or provided at an upper part or portion of the upper shell 12. The refrigerant discharge pipe 16 may be a passage along which a refrigerant compressed by the compressor part 3 and discharged to the inner space 1*a* of the casing 1 may be discharged to the outside. An oil separator (not shown) that separates oil mixed with the discharged refrigerant may be connected to the refrigerant discharge pipe 16.

A stator 21 which constitutes or forms the motor part 2 may be installed or provided at an upper part or portion of the casing 1, and a rotor 22 which constitutes or forms the motor part 2 together with the stator 21 and rotated by a reciprocal operation with the stator 21 may be rotatably installed or provided in the stator 21. A plurality of slots (not shown) may be formed on an inner circumferential surface of the stator 21 in a circumferential direction, on which a coil 25 may be wound. An oil collection passage 26 configured to pass oil therethrough may be formed between an outer circumferential surface of the stator 21 and an inner circumferential surface of the cylindrical shell 11, in a D-cut shape.

A main frame 31 which constitutes or forms the compression part 3 may be fixed to an inner circumferential surface of the casing 1, below the stator 21 with a predetermined gap therebetween. The main frame 31 may be coupled to the cylindrical shell 11 as an outer circumferential surface of the main frame 31 is welded or shrink-fit to an inner circumferential surface of the cylindrical shell 11.

A ring-shaped frame side wall portion or side wall (first side wall portion or side wall) 311 may be formed at an edge of the main frame 31, and a first shaft accommodating portion 312 configured to support a main bearing portion 51 of a rotational shaft 5, which is discussed hereinafter, may be formed at a central part or portion of the main frame 31. A first shaft accommodating hole 312*a*, configured to rotatably insert the main bearing portion 51 of the rotational shaft 5 and support the main bearing portion 51 in a radial direction, may be penetratingly-formed at the first shaft accommodating portion 312 in an axial direction.

A fixed scroll 32 may be installed or provided at a bottom surface of the main frame 31, in a state in which an orbiting scroll 33 eccentrically-coupled to the rotational shaft 5 is disposed between the fixed scroll 32 and the main frame 31. The fixed scroll 32 may be fixedly-coupled to the main frame 31, and may be fixed to the main frame 31 so as to be moveable in the axial direction.

The fixed scroll 32 may include a fixed plate portion or plate (hereinafter, referred to as a "first plate portion" or first "plate") 321 formed in an approximate disc shape, and a scroll side wall portion or side wall (hereinafter, referred to as a "second side wall portion" of "second side wall") 322 formed at an edge of the first plate portion 321 and coupled to an edge of a bottom surface of the main frame 31. A fixed wrap 323, which forms a compression chamber (V) by being engaged with an orbiting wrap 332, which is discussed hereinafter, may be formed on an upper surface of the first plate portion 321. The compression chamber (V) may be formed between the first plate portion 321 and the fixed wrap 323, and between the orbiting wrap 332, which is discussed hereinafter, and the second plate portion 331. The compression chamber (V) may include a suction chamber, an intermediate pressure chamber, and a discharge chamber consecutively formed in a moving direction of the wrap.

The compression chamber (V) may include a first compression chamber (V1) formed between an inner side surface of the fixed wrap 323 and an outer side surface of the orbiting wrap 332, and a second compression chamber (V2) formed between an outer side surface of the fixed wrap 323 and an inner side surface of the orbiting wrap 332. That is, as shown in FIG. 2, the first compression chamber (V1) may be formed between two contact points (P11, P12) generated as the inner side surface of the fixed wrap 323 and the outer side surface of the orbiting wrap 332 come in contact with each other. Under an assumption that a largest angle among angles formed by two lines which connect a center (O) of an eccentric portion with two contact points (P11, P12) is $\alpha$, a formula ($\alpha<360°$) is formed before a discharge operation is started. The second compression chamber (V2) may be formed between two contact points (P21, P22) generated as the outer side surface of the fixed wrap 323 and the inner side surface of the orbiting wrap 332 come in contact with each other.

The first compression chamber (V1) is formed such that a refrigerant is firstly suctioned thereinto prior to being suctioned into the second compression chamber (V2), and such that a compression path thereof is relatively long. However, as the orbiting wrap 332 is formed with irregularity, a compression ratio of the first compression chamber (V1) is lower than a compression ratio of the second compression chamber (V2). Further, the second compression chamber (V2) is formed such that a refrigerant is later suctioned thereinto after being suctioned into the first compression chamber (V1), and such that a compression path thereof is relatively short. However, as the orbiting wrap 332 is formed with irregularity, the compression ratio of the second compression chamber (V2) is higher than the compression ratio of the first compression chamber (V1).

An inlet 324, through which a refrigerant suction pipe 15 and a suction chamber may communicate with each other, may be penetratingly-formed at one side of the second side wall portion 322. An outlet 325, that communicates with a discharge chamber and through which a compressed refrigerant may be discharged, may be formed at a central part or portion of the first plate portion 321. The outlet 325 may be formed as one outlet that communicates with both of the first and second compression chambers (V1, V2). Alternatively, a plurality of the outlet 325 may be formed so as to communicate with the first and second compression chambers (V1, V2).

A second shaft accommodation portion 326, configured to support a sub bearing portion 52 of the rotational shaft 5, which is discussed hereinafter, may be formed at a central part or portion of the first plate portion 321 of the fixed scroll 32. A second shaft accommodating hole 326*a*, configured to support the sub bearing portion 52 in the radial direction, may be penetratingly-formed at the second shaft accommodating portion 326 in the axial direction.

A thrust bearing portion 327, configured to support a lower end surface of the sub bearing portion 52 in the axial direction, may be formed at a lower end of the second shaft accommodation portion 326. The thrust bearing portion 327 may protrude from a lower end of the second shaft accommodating hole 326*a* in the radial direction, towards a shaft center. However, the thrust bearing portion may be formed between a bottom surface of an eccentric portion 53 of the rotational shaft 5, which is discussed hereinafter, and the first plate portion 321 of the fixed scroll 32 corresponding thereto.

A discharge cover 34, configured to accommodate a refrigerant discharged from the compression chamber (V) therein and to guide the refrigerant to a refrigerant passage, which is discussed hereinafter, may be coupled to a lower side of the fixed scroll 32. The discharge cover 34 may be formed such that an inner space thereof may accommodate therein the discharge opening 325 and may accommodate therein an inlet of the refrigerant passage ($P_G$) along which a refrigerant discharged from the compression chamber (V1) may be guided to the inner space 1*a* of the casing 1.

The refrigerant passage ($P_G$) may be penetratingly-formed at the second side wall portion 322 of the fixed scroll 32 and the first side wall portion 311 of the main frame 31, sequentially, at an inner side of an oil passage separation portion 8. Alternatively, the refrigerant passage ($P_G$) may be formed so as to be consecutively recessed from an outer circumferential surface of the second side wall portion 322 and an outer circumferential surface of the first frame 311.

The orbiting scroll 33 may be installed or provided between the main frame 31 and the fixed scroll 32 so as to perform an orbiting motion. An Oldham's ring 35 to prevent rotation of the orbiting scroll 33 may be installed or provided between an upper surface of the orbiting scroll 33 and a bottom surface of the main frame 31 corresponding thereto, and a sealing member 36, which forms a back pressure chamber (S), may be installed or provided at an inner side than the Oldham's ring 35. Thus, the back pressure chamber (S) may be implemented as a space formed by the main frame 31, the fixed scroll 32, and the orbiting scroll 33, outside of the sealing member 36. The back pressure chamber (S) forms an intermediate pressure because a refrigerant of an intermediate pressure is filled therein as the back pressure chamber (S) communicates with the intermediate compression chamber (V) by a back pressure hole 321*a* provided at the fixed scroll 32. However, a space formed at an inner side than the sealing member 36 may also serve as a back pressure chamber as oil of high pressure is filled therein.

An orbiting plate portion or orbiting plate (hereinafter, referred to as a "second plate portion" or "second plate") 331 of the orbiting scroll 33 may be formed to have an approximate disc shape. The back pressure chamber (S) may be formed at an upper surface of the second plate portion 331, and the orbiting wrap 332, which forms the compression chamber by being engaged with the fixed wrap 322, may be formed at a bottom surface of the second plate portion 331.

The eccentric portion 53 of the rotational shaft 5, which is discussed hereinafter, may be rotatably inserted into a central part or portion of the second plate portion 331, such that a rotational shaft coupling portion 333 may pass therethrough in the axial direction.

The rotational shaft coupling portion 333 may be extended from the orbiting wrap 332 so as to form an inner end of the orbiting wrap 332. Thus, as the rotational shaft coupling portion 333 is formed to have a height high enough to be overlapped with the orbiting wrap 332 on a same plane, the eccentric portion 53 of the rotational shaft 5 may be overlapped with the orbiting wrap 332 on the same plane. With such a configuration, a repulsive force and a compressive force of a refrigerant may be applied to the same plane on the basis of the second plate portion to be attenuated from each other. This may prevent a tilted state of the orbiting scroll 33 due to the compressive force and the repulsive force.

An outer circumference of the rotational shaft coupling portion 333 may be connected to the orbiting wrap 332 to form the compression chamber (V) during a compression operation together with the fixed wrap 322. The orbiting wrap 332 may be formed to have an involute shape together with the fixed wrap 323. However, the orbiting wrap 332 may be formed to have various shapes. For example, as shown in FIG. 2, the orbiting wrap 332 and the fixed wrap 323 may be formed to have a shape implemented as a plurality of circles of different diameters and origin points may be connected to each other, and a curved line of an outermost side may be formed as an approximate oval having a long axis and a short axis.

A protrusion 328 that protrudes toward an outer circumference of the rotational shaft coupling portion 333, may be formed near an inner end (a suction end or a starting end) of the fixed wrap 323. A contact portion 328*a* may protrude from the protrusion 328. That is, the inner end of the fixed wrap 323 may be formed to have a greater thickness than other parts. With such a configuration, the inner end of the fixed wrap 323, having the largest compressive force among other parts of the fixed wrap 323, may have an enhanced wrap intensity and may have enhanced durability.

A concaved portion 335, engaged with the protrusion 328 of the fixed wrap 323, may be formed at an outer circumference of the rotational shaft coupling portion 333 which is opposite to the inner end of the fixed wrap 323. A thickness increase portion 335*a*, having its thickness increased from an inner circumferential part or portion of the rotational shaft coupling portion 333 to an outer circumferential part or portion thereof, may be formed at one side of the concaved portion 335, at an upstream side in a direction to form the compression chambers (V). This may enhance a compression ratio of the first compression chamber (V1) by shortening a length of the first compression chamber (V1) prior to a discharge operation.

A circular arc surface 335*b* having a circular arc shape may be formed at another side of the concaved portion 335.

A diameter of the circular arc surface 335*b* may be determined by a thickness of the inner end of the fixed wrap 323 and an orbiting radius of the orbiting wrap 332. If the thickness of the inner end of the fixed wrap 323, the diameter of the circular arc surface 335*b* is increased. This may allow the orbiting wrap around the circular arc surface 335*b* to have an increased thickness and thus to obtain durability. Further, as a compression path becomes longer, a compression ratio of the second compression chamber (V2) may be increased in correspondence thereto.

The rotational shaft 5 may be supported in the radial direction as an upper part or portion thereof is forcibly-coupled to a central part or portion of the rotor 22, and as a lower part or portion thereof is coupled to the compression part 3. Thus, the rotational shaft 5 transmits a rotational force of the motor part 2 to the orbiting scroll 33 of the compression part 3. As a result, the orbiting scroll 33 eccentrically-coupled to the rotational shaft 5 performs an orbiting motion with respect to the fixed scroll 32.

The main bearing portion 51, supported in the radial direction by being inserted into the first shaft accommodating hole 312*a* of the main frame 31, may be formed at a lower part or portion of the rotational shaft 5. The sub bearing portion 52, supported in the radial direction by being inserted into the second shaft accommodating hole 326*a* of the fixed scroll 32, may be formed below the main bearing portion 51. The eccentric portion 53, inserted into the rotational shaft coupling portion 333 of the orbiting scroll 33, may be formed between the main bearing portion 51 and the sub bearing portion 52.

The main bearing portion 51 and the sub bearing portion 52 may be formed to be concentric with each other, and the eccentric portion 53 may be formed to be eccentric from the main bearing portion 51 or the sub bearing portion 52 in the radial direction. The sub bearing portion 52 may be formed to be eccentric from the main bearing portion 51.

An outer diameter of the eccentric portion 53 may be formed to be smaller than a diameter of the main bearing portion 51, but larger than a diameter of the sub bearing portion 52, such that the rotational shaft 5 may be easily coupled to the eccentric portion 53 through the shaft accommodating holes 312*a*, 326*a*, and the rotational shaft coupling portion 333. However, in a case of forming the eccentric portion 53 using an additional bearing without integrally forming the eccentric portion 53 with the rotational shaft 5, the rotational shaft 5 may be coupled to the eccentric portion 53, without the configuration that the outer diameter of the eccentric portion 53 is larger than the diameter of the sub bearing portion 52.

An oil supply passage 5*a*, along which oil may be supplied to the bearing portions and the eccentric portion, may be formed in the rotational shaft 5. As the compression part 3 is disposed below the motor part 2, the oil supply passage 5*a* may be formed in a chamfering manner from a lower end of the rotational shaft 5 to a lower end of the stator 21 or to an intermediate height of the stator 21, or to a height higher than an upper end of the main bearing portion 51.

An oil feeder 6, configured to pump oil contained in the oil storage space 1*b*, may be coupled to a lower end of the rotational shaft 5, that is, a lower end of the sub bearing portion 52. The oil feeder 6 may include an oil supply pipe 61 insertion-coupled to the oil supply passage 5*a* of the rotational shaft 5, and an oil suctioning member 62, for example, propeller, inserted into the oil supply pipe 61 and configured to suction oil. The oil supply pipe 61 may be installed or provided to be immersed in the oil storage space 1*b* via a though hole 341 of the discharge cover 34.

An oil supply hole and/or an oil supply groove, configured to supply oil suctioned through the oil supply passage to an outer circumferential surface of each of the respective bearing portions and the eccentric portion, may be formed at the respective bearing portions and the eccentric portion, or at a position between the respective bearing portions. Thus, oil suctioned toward an upper end of the main bearing portion 51 along the oil supply passage 5*a* of the rotational shaft 5, an oil supply hole (not shown) and an oil supply groove (not shown), flows out of bearing surfaces from an upper end of the first shaft accommodating portion 312 of the main frame 31. Then, the oil flows down onto an upper surface of the main frame 31, along the first shaft accommodating portion 312. Then, the oil is collected in the oil storage space 1*b*, through an oil passage ($P_O$) consecutively formed on an outer circumferential surface of the main frame 31 (or through a groove that communicates or extends from the upper surface of the main frame 31 to the outer circumferential surface of the main frame 31) and an outer circumferential surface of the fixed scroll 32.

Further, oil, discharged to the inner space 1*a* of the casing 1 from the compression chamber (V) together with a refrigerant, may be separated from the refrigerant at an upper space of the casing 1. Then, the oil may be collected in the oil storage space 1*b*, through a passage formed on an outer circumferential surface of the motor part 2, and through the oil passage ($P_O$) formed on an outer circumferential surface of the compression part 3.

The lower compression type scroll compressor according to an embodiment may be operated as follows.

Firstly, once power is supplied to the motor part 2, the rotor 21, and the rotational shaft 5 may be rotated as a rotational force is generated. As the rotational shaft 5 is rotated, the orbiting scroll 33 eccentrically-coupled to the rotational shaft 5 may perform an orbiting motion by the Oldham's ring 35.

As a result, the refrigerant supplied from outside of the casing 1 through the refrigerant suction pipe 15 may be introduced into the compression chambers (V), and the refrigerant compressed as a volume of the compression chambers (V) is reduced by the orbiting motion of the orbiting scroll 33. Then, the compressed refrigerant may be discharged to an inner space of the discharge cover 34 through the discharge opening 325.

The refrigerant discharged to the inner space of the discharge cover 34 may circulate at the inner space of the discharge cover 34, thereby having its noise reduced. Then, the refrigerant may move to a space between the main frame 31 and the stator 21, and move to an upper space of the motor part 2 through a gap between the stator 21 and the rotor 22.

The refrigerant may have oil separated therefrom at the upper space of the motor part 2, and then be discharged to the outside of the casing 1 through the refrigerant discharge pipe 16. On the other hand, the oil may be collected in the oil storage space, a lower space of the casing 1, through a flow path between an inner circumferential surface of the casing 1 and the stator 21, and through a flow path between the inner circumferential surface of the casing 1 and an outer circumferential surface of the compression part 3. Such processes may be repeatedly performed.

The compression chamber (V) formed between the fixed scroll 32 and the orbiting scroll 33 has a suction chamber at an edge region, and has a discharge chamber at a central region on the basis of the orbiting scroll 33. As a result, the fixed scroll 32 and the orbiting scroll 33 may have a highest temperature at the central region, and have a lowest temperature at the edge region. Especially, a suction refrigerant temperature is about 18° C. at the suction chamber, whereas a discharge refrigerant temperature is about 80° C. at the discharge chamber. This may cause a temperature around the suction chamber to be much lower than a temperature around the discharge chamber.

However, a high temperature refrigerant discharged from the discharge chamber spreads to an entire region of an inner space of the discharge cover 34, thereby contacting a rear surface of the first plate portion 321 of the fixed scroll 32 which forms the inner space of the discharge cover 34. As a result, the first plate portion 321 of the fixed scroll 32 has a tendency to expand to an edge region by receiving heat from the high temperature refrigerant. On the other hand, the fixed wrap 323, far from the inner space of the discharge cover 34, has a smaller tendency to expand than the first plate portion 321. Due to such a thermal transformation difference, the fixed scroll 32 is transformed in a shape to contract in a wrap direction. Especially, the fixed wrap near the suction chamber is much influenced by a suction refrigerant temperature than the fixed wrap at another region, thereby having a tendency to contract. This may cause an end of the fixed wrap near the suction chamber to be more contracted (more transformed) than the fixed wrap which is positioned at an opposite side to the suction chamber.

As a result, as the orbiting scroll 33 is pushed in an opposite direction to the suction chamber, a gap may occur between a side surface of the orbiting wrap 332 and a side surface of the fixed wrap 323. This may cause the compression chamber (V) not to be sealed due to the gap, resulting in a compression loss or a frictional loss between the wraps and abrasion.

Figure 3:
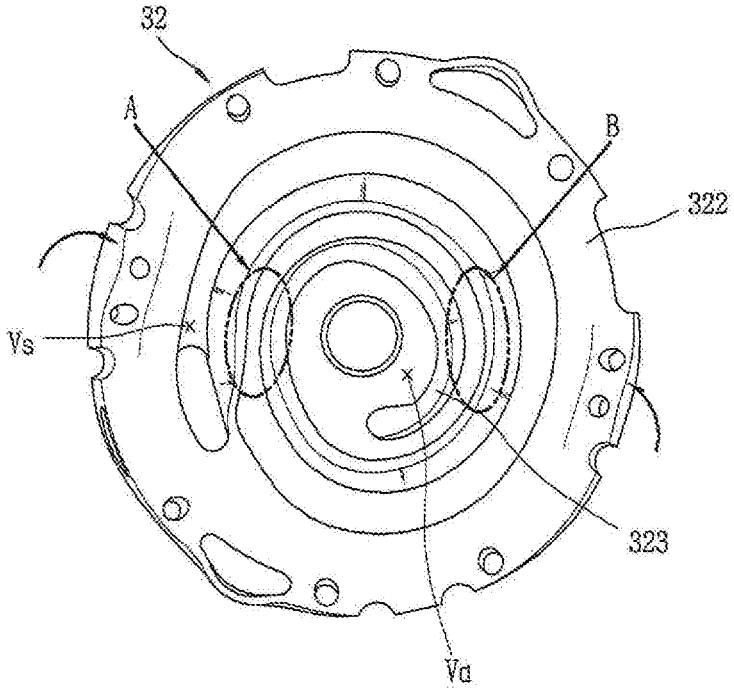
FIG. 3 is a planar view illustrating a thermally-deformed state of a fixed scroll in the scroll compressor of FIG. 1.
Figure 4:
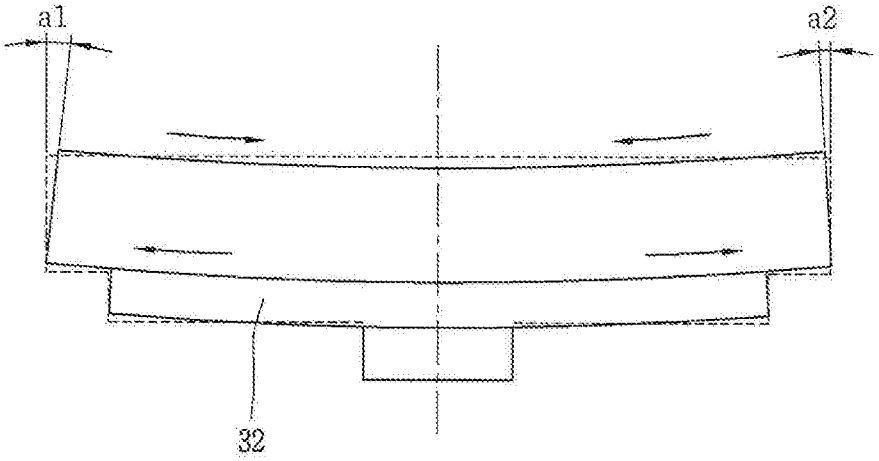
FIG. 4 is a frontal schematic view of the fixed scroll of FIG. 3.
Figure 5:
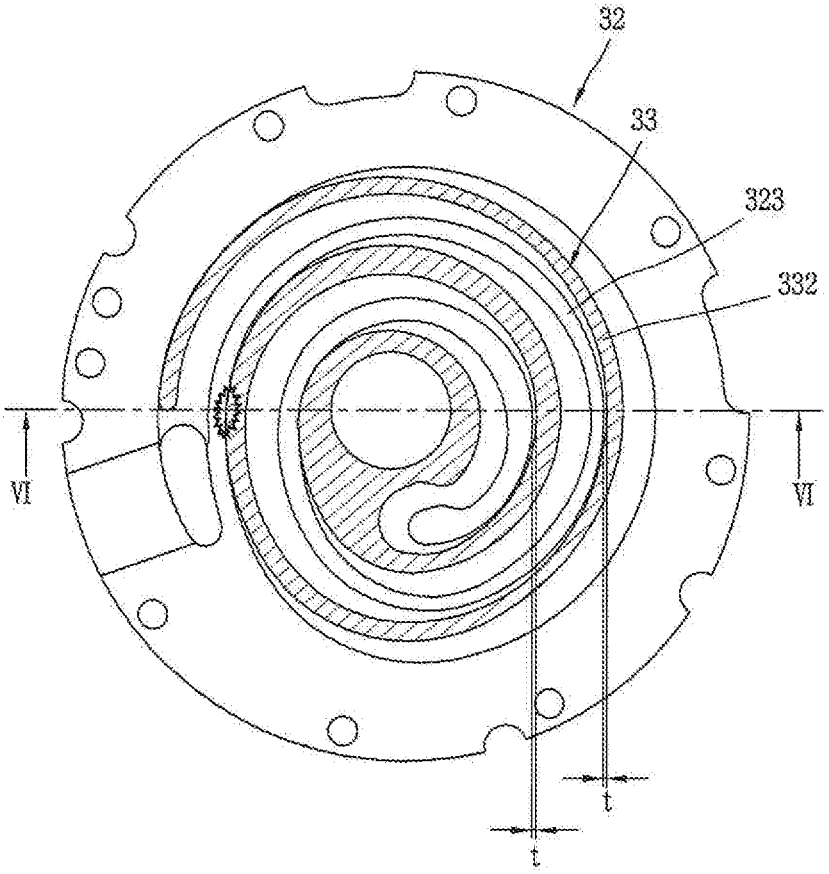
FIG. 5 is a sectional view illustrating a partial interference between a fixed wrap and an orbiting wrap, in a coupled state of an orbiting scroll to the fixed scroll of FIG. 3.
Figure 6:
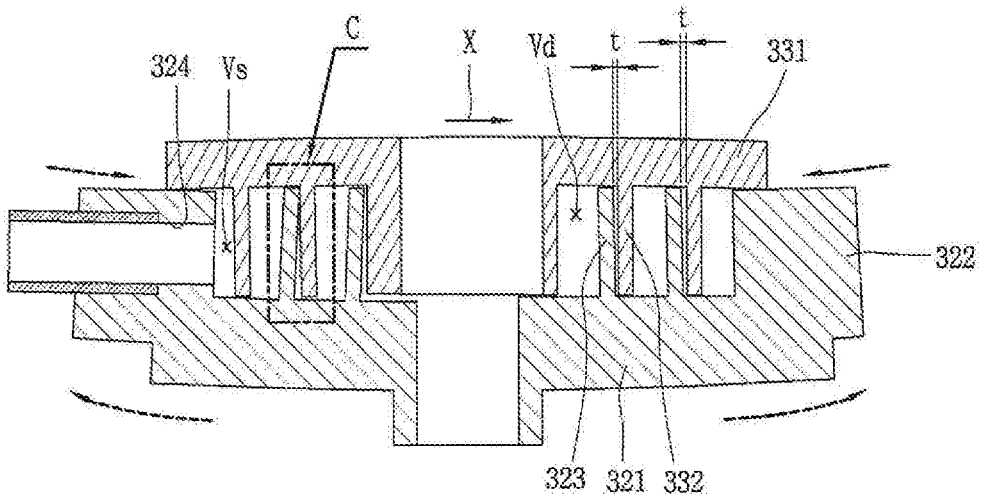
FIG. 6 is a sectional view taken along line 'VI-VI' in FIG. 5.
Figure 7:
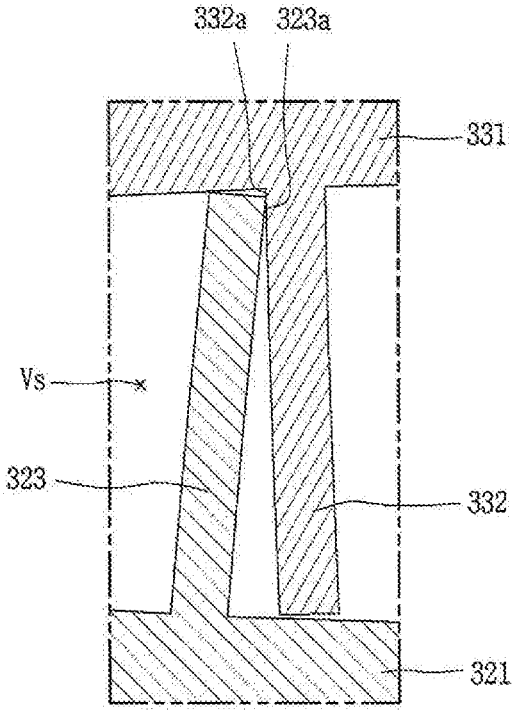
FIG. 7 is a sectional view which illustrates part C" of FIG. 6 in an enlarged manner.

FIG. 3 is a planar view illustrating a thermally-deformed state of a fixed scroll in the scroll compressor of FIG. 1. FIG. 4 is a frontal schematic view of the fixed scroll of FIG. 3. FIG. 5 is a sectional view illustrating a partial interference between a fixed wrap and an orbiting wrap, in a coupled state of an orbiting scroll to the fixed scroll of FIG. 3. FIG. 6 is a sectional view taken along line 'VI-VI' in FIG. 5. FIG. 7 is a sectional view which illustrates part C" of FIG. 6 in an enlarged manner.

As shown, the first plate portion 321 of the fixed scroll 32 is bent towards an upper side, that is, an opposite direction to a contact surface with the discharge cover 34. A region (A) near the suction chamber (Vs) is more bent than an opposite region (crank angle of 180°) (B) by a predetermined angle ($\alpha$1-$\alpha$2).

On the other hand, as a rear surface of the second plate portion 331 contacts the back pressure chamber (S), which forms an intermediate pressure, the orbiting scroll 33 is less transformed than the fixed scroll 32, as shown in FIGS. 5 and 6. As a result, as shown in FIG. 7, an edge of an end 323*a* of the fixed wrap 323 may interfere with a side surface of a root 332*a* of the orbiting wrap 332 contacting right side of the second plate portion 331. Accordingly, the orbiting scroll 33 is pushed to the side (the right side in the drawing), an opposite side to the suction chamber on the basis of a center of the fixed scroll (X). If the orbiting scroll 33 is pushed with respect to the fixed scroll 32 in the radial direction, a gap (t) occurs between a side surface of the orbiting wrap 332 and a side surface of the fixed wrap 323. This may cause a compression loss.

Considering this, in this embodiment, a reinforcing portion which constitutes a reinforcing section is formed near the suction chamber of the fixed wrap. This may prevent a thermal transformation of the fixed wrap near the suction chamber. As interference between the fixed wrap and the orbiting wrap is prevented from occurring near the suction chamber, leakage of a compressed refrigerant, occurring at an opposite side to the suction chamber as the fixed wrap and the orbiting wrap are spaced from each other, may be prevented.

Figure 8:
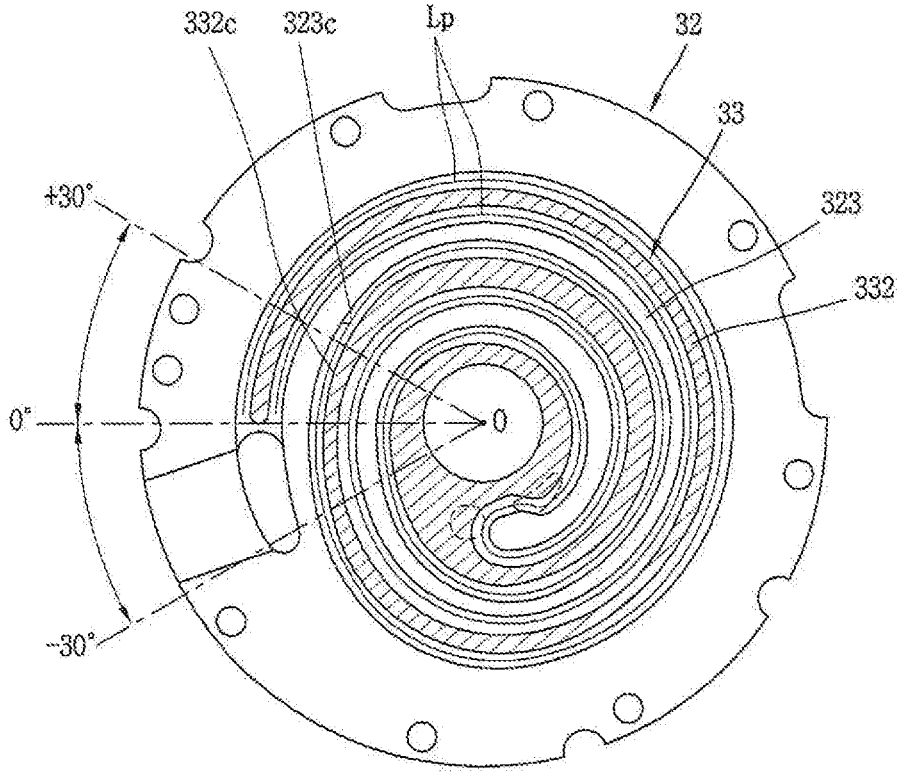
FIG. 8 is a planar view illustrating a coupled state of a fixed scroll having a reinforcing portion and an orbiting scroll having an accommodating portion, in a concentric state of the fixed scroll and the orbiting scroll in a scroll compressor according to an embodiment.
Figure 9:
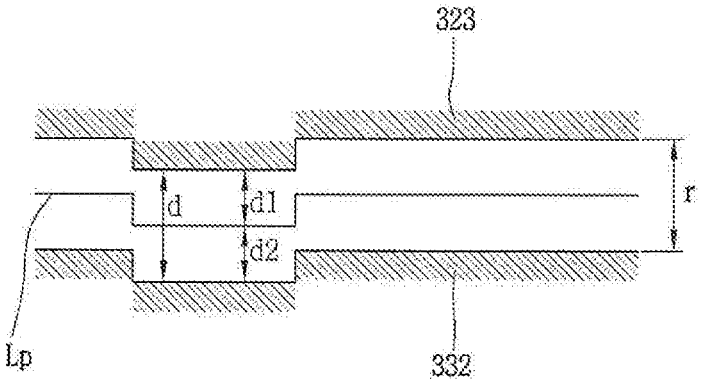
FIG. 9 is a schematic partial-unfolded view of a fixed wrap having a reinforcing portion and an orbiting wrap having an accommodating portion of FIG. 8.
Figure 10:
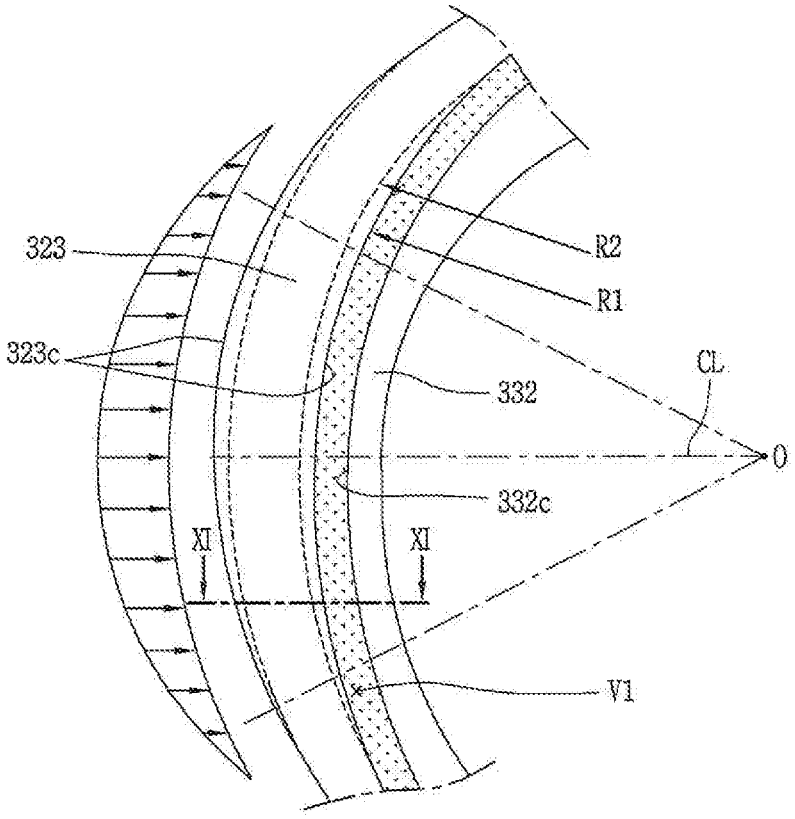
FIG. 10 is a planar view illustrating the reinforcing portion and the accommodating portion of FIG. 8 in an enlarged manner.
Figure 11:
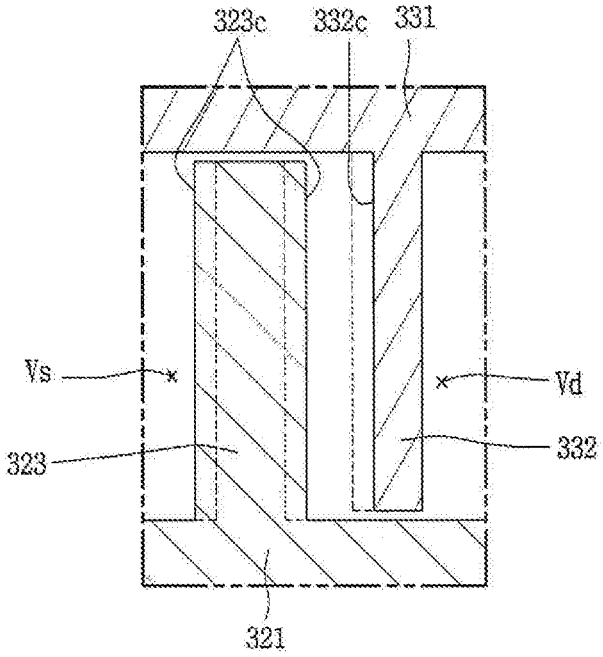
FIG. 11 is a sectional view taken along line 'XI-XI' in FIG. 10.

FIG. 8 is a planar view illustrating a coupled state of a fixed scroll having a reinforcing portion and an orbiting scroll having an accommodating portion, in a concentric state of the fixed scroll and the orbiting scroll in a scroll compressor according to an embodiment. FIG. 9 is a schematic partial-unfolded view of a fixed wrap having a reinforcing portion and an orbiting wrap having an accommodating portion of FIG. 8. FIG. 10 is a planar view illustrating the reinforcing portion and the accommodating portion of FIG. 8 in an enlarged manner. FIG. 11 is a sectional view taken along line 'XI-XI' in FIG. 10.

As shown in FIG. 8, a reinforcing portion 323*c* may protrude from an inner side surface of the fixed wrap 323, and an accommodating portion 332*c* to accommodate the reinforcing portion 323*c* therein may be concaved from an outer side surface of the orbiting wrap 332 corresponding thereto. The accommodating portion 332*c* may be formed to be inversely-symmetrical to the reinforcing portion 323*c* on the basis of a center line between the two wraps (envelope) (Lp).

That is, in a case in which the reinforcing portion 323*c* is formed on an inner side surface of the fixed wrap 323 as a protrusion having a predetermined sectional area, the accommodating portion 332*c* to accommodate the reinforcing portion 323*c* therein may be concaved from an outer side surface of the orbiting wrap 332 corresponding thereto, in the form of a groove concaved by a protruded length of the reinforcing portion 323*c*. In this case, as shown in FIG. 9, the reinforcing portion 323*c* and the accommodating portion 332*c* may be formed to be inversely-symmetrical to each other on the basis of the center line between the two wraps (envelope) (Lp), that is, an envelope formed along a compression path of the first compression chamber (V1). With such a configuration, even in a case in which the reinforcing portion 323*c* and the accommodating portion 332*c* are formed, a distance (d) between the two wraps obtained by adding a distance (d1) from the envelope (Lp) to an inner side surface of the fixed wrap 323, to a distance (d2) from the envelope (Lp) to an outer side surface of the orbiting wrap 332, is always the same as an orbiting radius (r).

As the reinforcing portion 323*c* and the accommodating portion 332*c* are configured to prevent a thermal transformation of the fixed wrap 323, they may be formed at a region at which a stress due to a thermal transformation is applied the most, that is, at least one of sections which constitute the suction chamber (Vs). For example, the reinforcing portion 323*c* may be formed within a range of ±30° from a center (O) of the fixed scroll 32, on the basis of a suction completion point of the fixed wrap 323. The accommodating portion 332*c* may be formed at the orbiting wrap 332 within a range corresponding to the reinforcing portion 323*c* of the fixed wrap 323.

The suction completion point means a time point when a suction operation is completed at the first compression chamber (V1) formed by an inner side surface of the fixed wrap 323, that is, a time point when a suction end of the orbiting wrap 332 contacts an inner side surface of the fixed wrap 323. In this case, a crank angle is 0° (zero). When the crank angle is −30°, an angle is formed between a virtual line which connects a center (O) of the fixed scroll 32 with the suction completion point, and a farthest side wall surface of the inlet 324, that is, a farthest point in an opposite direction to a compression direction.

As shown in FIG. 8, the reinforcing portion 323*c* may be formed on both an inner side surface and an outer side surface of the fixed wrap 323. However, in some cases, the reinforcing portion 323*c* may be formed on one of an inner side surface or an outer side surface of the fixed wrap 323.

If the reinforcing portion 323*c* is formed on only an inner side surface of the fixed wrap 323, the accommodating portion 332*c* of the orbiting wrap 332 should have a great depth, because the reinforcing portion 323*c* has an increased sectional area. This may cause a wrap thickness of the orbiting wrap 332 to be reduced. As a result, an intensity may be lowered, and reliability may be significantly lowered while the scroll compressor is operated with a high compression ratio.

On the other hand, if the reinforcing portion 323*c* is formed on only an outer side surface of the fixed wrap 323, the reinforcing portion 323*c* positioned at the suction chamber (Vs) may have an increased sectional surface. This may cause a volume of the suction chamber (Vs) to be reduced, resulting in increasing a suction loss.

Thus, as shown in FIGS. 10 and 11, the reinforcing portion 323*c* may be formed on both the inner side surface and the outer side surface of the fixed wrap 323, with a ratio of 50:50 or with a predetermined ratio. Hereinafter, a detailed shape of each of the reinforcing portion and the accommodating portion will be explained with an example that the reinforcing portion is formed at the fixed wrap and the accommodating portion is formed at the orbiting wrap.

The reinforcing portion 323*c* may be formed at a partial region of the fixed wrap 323 including a corresponding section (the aforementioned±30°). The reinforcing portion 323*c* may be formed to protrude from a wrap root of the fixed wrap 323 contacting the first plate portion 321 to a wrap end, with a uniform width.

In this case, as shown in FIG. 10, a stress is largest at a suction completion point (crank angle of 0°), and is gradually reduced at both sides of the suction completion point. Considering this, the reinforcing portion 323*c* may be formed such that its thickness may be largest at the suction completion point having the largest stress, and such that its thickness may be gradually reduced towards two sides of the suction completion point.

Likewise, the accommodating portion 332*c* may be formed at a partial region of the orbiting wrap 332 including a corresponding section (the aforementioned±30°). The accommodating portion 332*c* may be formed to be concaved from a wrap root of the orbiting wrap 332 to a wrap end, with a uniform width. In this case, the accommodating portion 332*c* may be formed such that its depth may be greatest at the suction completion point where a protruded height of the reinforcing portion 323*c* is the greatest, and such that its depth may be gradually reduced towards two sides of the suction completion point.

That is, when the reinforcing portion 323*c* and the accommodating portion 332*c* are formed in a curved shape, each reinforcing portion 323*c* may be formed as a curved surface having one curvature radius. The curvature radius of the reinforcing portion 323*c* may be larger than a curvature radius (R1) of the fixed wrap 323 at a corresponding position. The accommodating portion of the orbiting wrap may be formed vice versa. Although not shown, the reinforcing portion may be formed in a straight shape such that its depth may be constant. In this case, two ends of the reinforcing portion may be formed as a curved surface for slidable contact between the wraps.

With such a configuration, in the fixed scroll according to this embodiment, even if the plate portion is thermally transformed (elongated in the radial direction) by being heated by a high-temperature refrigerant discharged to the inner space of the discharge cover, a wrap thickness of the fixed wrap is increased at a section having the largest stress. This may prevent a transformation of the fixed wrap at a corresponding section to a maximum. This may prevent refrigerant leakage through a gap formed between the fixed wrap and the orbiting wrap at an opposite side to a suction side, due to a partial interference therebetween.

Figure 12:
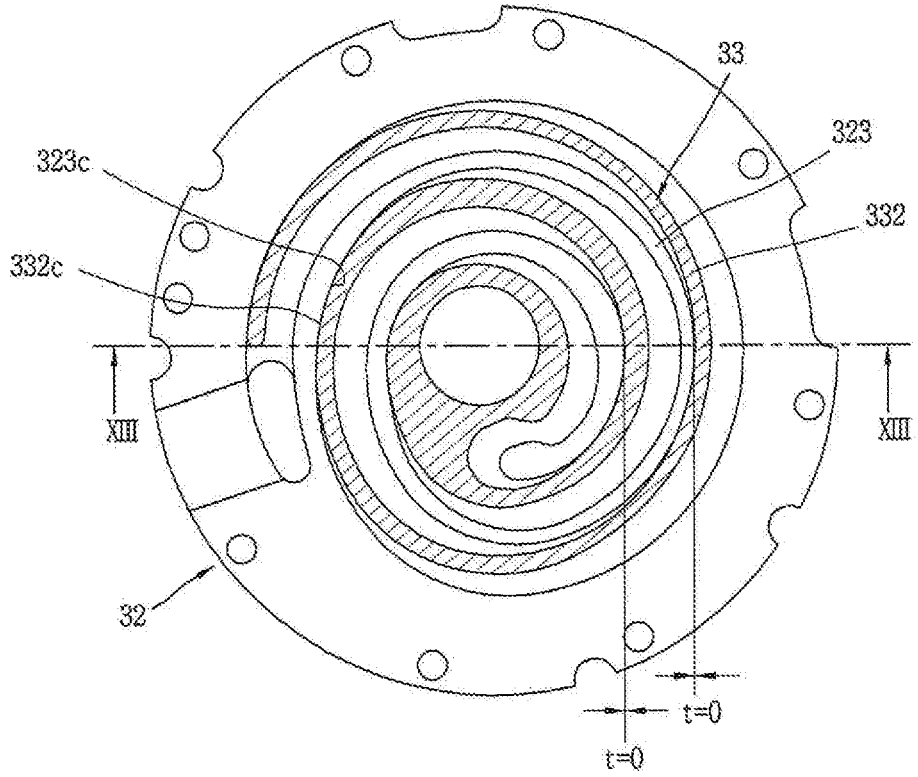
FIG. 12 is a planar view illustrating a coupled state of a fixed scroll having a reinforcing portion and an orbiting scroll having an accommodating portion according to an embodiment.
Figure 13:
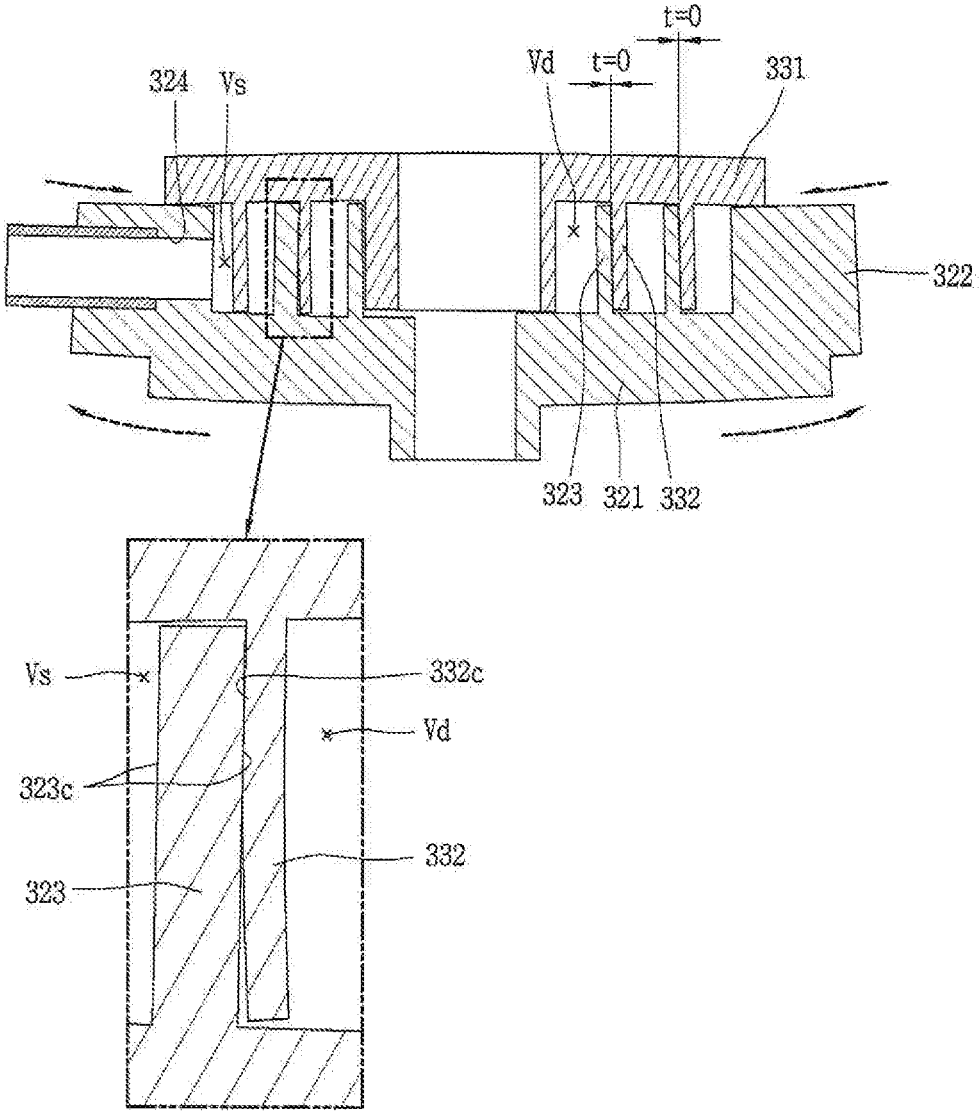
FIG. 13 is a sectional view taken along line 'XIII-XIII' in FIG. 12.

FIG. 12 is a planar view illustrating a coupled state of a fixed scroll having a reinforcing portion and an orbiting scroll having an accommodating portion according to an embodiment. FIG. 13 is a sectional view taken along line 'XIII-XIII' in FIG. 12.

As shown, when the inlet 324 is formed on the side (left side in the drawing), an end of the fixed wrap 323 is more greatly bent to the side (right side in the drawing) at a section of the fixed wrap 323 adjacent to the Inlet 324. This may cause the end of the fixed wrap 323 to interfere with a root of the orbiting wrap 332. However, if the reinforcing portion 323*c* is formed on a side surface (right side in the drawing) of the fixed wrap 323, the fixed wrap 323 near the suction chamber is in an upright state without being thermally transformed as shown in FIG. 13. Even if the reinforcing portion 323*c* is thermally transformed, the degree of the thermal transformation is not great.

If the accommodating portion 332*c* is formed on a side surface (left side in the drawing) of the orbiting wrap 332, the fixed wrap 323 near the suction chamber and the orbiting wrap 332 do not interfere with each other. This may prevent the orbiting scroll 33 from being moved to the side (right side in the drawing). As a result, as shown in FIG. 13, the fixed wrap 323 and the orbiting wrap 332 do not have a gap therebetween on the side (right side in the drawing) on the basis of the rotational shaft coupling portion. Even if the fixed wrap 323 and the orbiting wrap 332 are spaced from each other, a spacing distance therebetween may be minimized and thus leakage of a compressed refrigerant may be minimized.

Another embodiment of the reinforcing portion and the accommodating portion will be explained hereinafter.

In the aforementioned embodiment, the reinforcing portion or both of the reinforcing portion and the accommodating portion may be formed to be inclined from a wrap root to a wrap end. However, in this embodiment, the reinforcing portion and the accommodating portion may be respectively formed at the wrap end and the wrap root, with a stair-step, with consideration of a processability.

Figure 14:
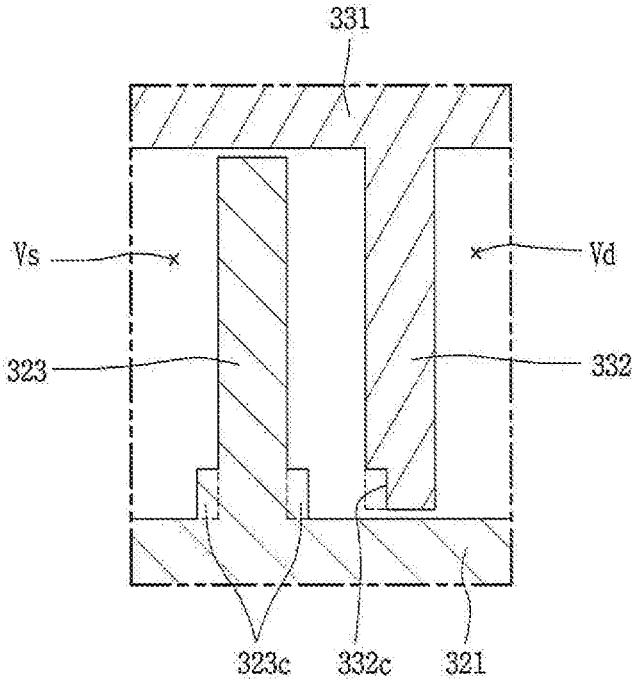
FIGS. 14 and 15 are longitudinal sectional views illustrating other embodiments of the reinforcing portion.

For example, as shown in FIG. 14, the reinforcing portion 323*c* may be formed at a wrap root inside the fixed wrap 323, in the form of protrusions with a stair-step. On the other hand, the accommodating portion 332*c* may be formed at an edge of an outer end of the orbiting wrap 332, in the form of a groove with a stair-step.

In this case, the reinforcing portion may be formed out of a range of ±30° on the basis of a virtual line (CL) which connects a center (O) of the scroll with a suction completion point. However, with consideration of a stress distribution with respect to a thermal transformation, a sectional area of the reinforcing portion 323*c* formed within the range may be larger than a sectional area of the reinforcing portion 323*c* formed out of the range. Further, with consideration of a stress distribution, the reinforcing portion 323*c* may be formed to have a largest thickness at a point consistent with the virtual line (CL), and to have a decreased thickness towards two sides on the basis of the point consistent with the virtual line (CL).

The accommodating portion 332*c* may be formed to be inverse-symmetrical to the reinforcing portion 323*c*. That is, the accommodating portion 332*c* may be formed to have a greatest depth at a point consistent with the virtual line (CL), and to have a decreased depth towards two sides on the basis of the point consistent with the virtual line (CL).

The reinforcing portion and the accommodating portion according to this embodiment have a configuration and effects similar to those according to the aforementioned embodiment except for the following. In the aforementioned embodiment, in a case of forming the reinforcing portion 323*c* on an entire region of a side surface of the fixed wrap 323, a wrap thickness of the orbiting wrap 332 may be reduced, and thus, an intensity of the orbiting wrap 332 may be lowered. However, in this embodiment, in a case of forming the reinforcing portion 323*c* at a root of the fixed wrap 323 and forming the accommodating portion 332*c* only at an end of the orbiting wrap 332, the orbiting wrap 332 may maintain its thickness at a root thereof. This may allow the orbiting wrap 332 to maintain its intensity, resulting in enhancing reliability.

In this embodiment, as the reinforcing portion 323*c* is formed at the root of the fixed wrap 323, even if the fixed wrap 323 is transformed a little, a wrap thickness of the fixed wrap 323 is not increased at an end of the fixed wrap 323. This may not increase a displacement width. With such a configuration, an interference amount between the fixed wrap 323 and the orbiting wrap 332 is relatively reduced when the fixed wrap 323 is thermally-transformed, and thus, a pushed amount of the orbiting scroll 33 is reduced. This may reduce a gap between the fixed wrap 323 and the orbiting wrap 332, thereby preventing lowering of efficiency of the scroll compressor due to refrigerant leakage.

Still another embodiment of the reinforcing portion and the accommodating portion will be explained hereinafter.

In the aforementioned embodiments, the reinforcing portion is formed such that a side surface thereof has a vertical shape. However, in this embodiment, a side surface of the reinforcing portion and a side surface of the accommodating portion corresponding thereto are formed to be inclined.

Figure 15:
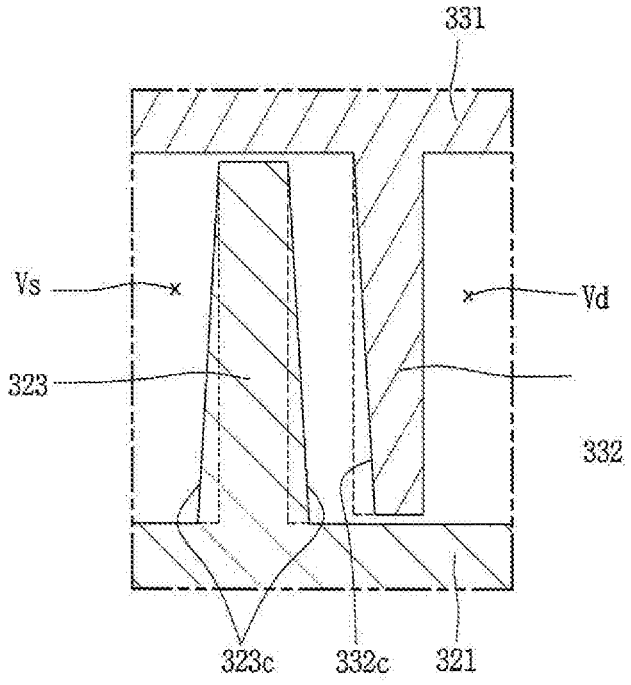

For example, as shown in FIG. 15, the reinforcing portion 323*c* in this embodiment may be inclined such that a wrap thickness may be increased towards a wrap root from a wrap end. On the other hand, the accommodating portion 332*c* in this embodiment may be inclined such that a wrap thickness is decreased towards a wrap root from a wrap end.

The reinforcing portion 323*c* and the accommodating portion 332*c* may be configured to prevent interference between the fixed wrap 323 near the suction chamber (Vs) and the orbiting wrap 332, due to bending towards a central region. Therefore, the reinforcing portion 323*c* may be formed on an inner side surface of the fixed wrap 323, and the accommodating portion 332*c* may be formed on an outer side surface of the orbiting wrap 332. Alternatively, the reinforcing portion may be formed on an outer side surface of the fixed wrap 323.

The reinforcing portion and the accommodating portion according to this embodiment have a configuration and effects similar to those according to the aforementioned embodiment except for the following. In this embodiment, the reinforcing portion is formed such that a wrap thickness is reduced towards a wrap end. Even if the fixed wrap is partially bent towards the center of the fixed scroll due to a thermal transformation of the fixed scroll, interference between the orbiting wrap and the fixed wrap may be prevented, because the reinforcing portion is formed to be inclined. This may prevent refrigerant leakage at an opposite side to a suction side due to interference between the fixed wrap and the orbiting wrap, resulting in enhanced efficiency of the scroll compressor.

Embodiments disclosed herein provide a scroll compressor capable of preventing a compression loss due to leakage of a compressed refrigerant, the compression loss occurring as a fixed wrap and an orbiting wrap are spaced from each other. Embodiments disclosed herein further provide a scroll compressor capable of preventing an orbiting scroll from being pushed by preventing a thermal transformation of a specific part of a fixed wrap. Embodiments disclosed herein also provide a scroll compressor capable of preventing a frictional loss or abrasion between a fixed scroll and an orbiting scroll, due to an excessive contact between a fixed wrap and an orbiting wrap at a specific part or portion.

Embodiments disclosed herein provide a scroll compressor that may include a fixed scroll having a fixed wrap, having an inlet at an edge region thereof, and having an outlet at a central region thereof; and an orbiting scroll having an orbiting wrap to form a compression chamber by being engaged with the fixed wrap. A wrap thickness of the fixed wrap near the inlet may be increased.

Embodiments disclosed herein provide a scroll compressor that may include a fixed scroll having a fixed wrap, having an inlet at an edge region thereof, and having an outlet at a central region thereof; and an orbiting scroll having an orbiting wrap to form a compression chamber by being engaged with the fixed wrap. A wrap thickness of the fixed wrap may be greater than that of the orbiting wrap within a range from a point where the inlet starts to a suction completion point on the basis of a center of the fixed scroll.

Embodiments disclosed herein provide a scroll compressor that may include a fixed scroll having a fixed wrap, having an inlet at an edge region thereof, and having an outlet at a central region thereof; and an orbiting scroll having an orbiting wrap to form a compression chamber by being engaged with the fixed wrap. A protrusion portion may be extended in a radial direction from an inner side surface of the fixed wrap which faces the inlet, and a groove portion may be formed on an outer side surface of the orbiting wrap corresponding thereto.

Embodiments disclosed herein provide a scroll compressor that may include an orbiting scroll having an orbiting wrap, and which performs an orbiting motion; and a fixed scroll having a fixed wrap to form a compression chamber including a suction chamber, an intermediate pressure chamber, and a discharge chamber, by being engaged with the orbiting wrap. A wrap thickness of the fixed wrap may be greater than that of the orbiting wrap within a range which forms the suction chamber. A distance between the fixed wrap and the orbiting wrap within the range may be equal to an orbiting radius of the orbiting scroll.

A wrap thickness of the fixed wrap within the range may be gradually increased towards a suction completion point. At least one of an inner side surface or an outer side surface of the orbiting wrap within the range may be formed as a curved line inversely-symmetric with a side surface of the fixed wrap corresponding thereto, on the basis of a center line between the two wraps.

Embodiments disclosed herein provide a scroll compressor that may include an orbiting scroll having an orbiting wrap, and which performs an orbiting motion; and a fixed scroll having a fixed wrap to form a compression chamber including a suction chamber, an intermediate pressure chamber, and a discharge chamber, by being engaged with the orbiting wrap. In a state in which the orbiting scroll and the fixed scroll are concentric with each other, within a range of ±30° from centers of the two scrolls on the basis of a suction completion point formed on an inner side surface of the fixed wrap and in which suction with respect to the compression chamber is completed, a reinforcing portion is formed on at least one of an inner side surface or an outer side surface of the fixed wrap, and a wrap thickness of the fixed wrap is increased at the reinforcing portion.

The reinforcing portion may be formed on a side surface of the fixed wrap out of the range, and a sectional area of the reinforcing portion within the range may be larger than that of the reinforcing portion out of the range. An accommodating portion to accommodate the reinforcing portion therein may be formed on a side surface of the orbiting wrap corresponding to the reinforcing portion, and a wrap thickness of the orbiting wrap may be reduced at the accommodating portion.

The reinforcing portion may be formed at a root of the fixed wrap. The reinforcing portion may be formed such that a sectional area thereof may be increased towards a wrap root from a wrap end.

An accommodating portion to accommodate the reinforcing portion therein may be formed on a side surface of the orbiting wrap corresponding to the reinforcing portion, and a wrap thickness of the orbiting wrap may be reduced at the accommodating portion.

Embodiments disclosed herein provide a scroll compressor that may include a fixed scroll having a fixed plate portion or plate, a fixed wrap that protrudes from the fixed plate portion, an inlet formed near an outer side end of the fixed wrap, and one or more outlets formed near an inner side end of the fixed wrap, the fixed plate portion exposed to a space that communicates with the outlet; an orbiting scroll having an orbiting plate portion or plate, and an orbiting wrap that protrudes from the orbiting plate portion and engaged with the fixed wrap, the orbiting wrap which forms a compression chamber including a suction chamber, an intermediate pressure chamber, and a discharge chamber, from an outer side to an inner side in a wrap moving direction together with the fixed plate portion, the fixed wrap and the orbiting plate portion, while performing an orbiting motion with respect to the fixed wrap. The fixed wrap may be formed such that its wrap thickness at a section which forms the suction chamber is increased towards a suction completion point. At least one of an inner side surface or an outer side surface of the orbiting wrap within the range may be formed as a curved line inversely-symmetric with a side surface of the fixed wrap corresponding thereto, on the basis of a center line between the two wraps.

Embodiments disclosed herein provide a scroll compressor that may include a casing; a drive motor provided at an inner space of the casing; a rotational shaft coupled to a rotor of the drive motor, and rotated together with the rotor; a frame installed or provided below the drive motor; a fixed scroll provided below the frame, having an inlet and an outlet, and having a fixed wrap; an orbiting scroll provided between the frame and the fixed scroll, and having an orbiting wrap which forms a compression chamber including a suction chamber, an intermediate pressure chamber, and a discharge chamber, by being engaged with the fixed wrap, the orbiting scroll having a rotational shaft coupling portion for coupling the rotational shaft in a penetrating manner; and a discharge cover coupled to a lower side of the fixed scroll, and configured to accommodate the outlet therein in order to guide a refrigerant discharged through the outlet to the inner space of the casing. In a state in which the orbiting scroll and the fixed scroll are concentric with each other, a wrap thickness of the fixed wrap may be greater than that of the orbiting wrap within a range which forms the suction chamber. A distance from the fixed wrap to the orbiting wrap within the range may be the same as an orbiting radius of the orbiting scroll. A wrap thickness of the fixed wrap within the range may be gradually increased towards a suction completion point.

At least one of an inner side surface or an outer side surface of the orbiting wrap within the range may be formed as a curved line inversely-symmetric with a side surface of the fixed wrap corresponding thereto, on the basis of a center line between the two wraps. In a state in which the orbiting scroll and the fixed scroll are concentric with each other, the range may correspond to ±30° from centers of the two scrolls on the basis of a suction completion point formed on an inner side surface of the fixed wrap and in which suction with respect to the compression chamber is completed.

The compression chamber may include a first compression chamber formed on an inner side surface of the fixed wrap, and a second compression chamber formed on an outer side surface of the fixed wrap. The first compression chamber may be defined between two contact points P11 and P12 generated as the inner side surface of the fixed wrap contacts an outer side surface of the orbiting wrap. A formula of $0° < \alpha < 360°$ may be formed, where $\alpha$ is an angle defined by two lines which connect a center O of the eccentric portion to the two contact points P1 and P2, respectively.

The scroll compressor of the embodiments may have at least the following advantages.

First, as a wrap thickness of the fixed wrap is great within a range which forms the suction chamber, a thermal transformation of the fixed wrap at the suction chamber may be prevented. This may prevent a gap between the fixed wrap and the orbiting wrap at an opposite side to the suction chamber, due to interference of the fixed wrap and the orbiting wrap at a specific part or portion. As a result, refrigerant leakage may be prevented, and thus, compression efficiency may be enhanced.

Second, as a thermal transformation of the fixed wrap, an excessive contact between the fixed wrap and the orbiting wrap at a specific part or portion may be prevented. This may reduce a frictional loss, or abrasion of the fixed scroll or the orbiting scroll, thereby enhancing a reliability of the scroll compressor.

Further scope of applicability of the present application will become more apparent from the detailed description given. However, it should be understood that the detailed description and specific examples, while indicating embodiments, are given by way of illustration only, as various changes and modifications within the spirit and scope will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

an orbiting scroll having an orbiting wrap, and which performs an orbiting motion;

a fixed scroll having a fixed wrap to form a compression chamber including a suction chamber, an intermediate pressure chamber, and a discharge chamber, by being engaged with the orbiting wrap, and having an inlet at an edge region thereof and an outlet at a central region thereof; and a discharge cover coupled to the fixed scroll, and configured to accommodate a refrigerant discharged through the outlet, wherein in a state in which the orbiting scroll and the fixed scroll are concentric with each other, a reinforcing portion is provided at at least one of an inner side surface or an outer side surface of the fixed wrap that is adjacent to the inlet, within a range of ±30° based on a virtual line which passes through a center of the fixed scroll and a suction end of the orbiting wrap which contacts the inner side surface of the fixed wrap, and wherein a wrap thickness of the fixed wrap within the range is formed to be thicker than a wrap thickness of the fixed wrap outside of the range.

2. The scroll compressor of claim 1, wherein the reinforcing portion is formed on a side surface of the fixed wrap outside of the range, and wherein a sectional area of the reinforcing portion within the range is larger than a sectional area of the reinforcing portion outside of the range.

3. The scroll compressor of claim 1, wherein an accommodating portion to accommodate the reinforcing portion therein is formed on a side surface of the orbiting wrap corresponding to the reinforcing portion, and a wrap thickness of the orbiting wrap is reduced at the accommodating portion.

4. The scroll compressor of claim 1, wherein the reinforcing portion is formed at a root of the fixed wrap.

5. The scroll compressor of claim 4, wherein an accommodating portion to accommodate the reinforcing portion therein is formed on a side surface of the orbiting wrap corresponding to the reinforcing portion, and a wrap thickness of the orbiting wrap is reduced at the accommodating portion.

6. The scroll compressor of claim 1, wherein the reinforcing portion is formed such that a sectional area thereof increases towards a wrap root from a wrap end.

7. The scroll compressor of claim 6, wherein an accommodating portion to accommodate the reinforcing portion therein is formed on a side surface of the orbiting wrap corresponding to the reinforcing portion, and a wrap thickness of the orbiting wrap is reduced at the accommodating portion.

8. A scroll compressor, comprising:

a fixed scroll having a fixed plate, a fixed wrap that protrudes from the fixed plate, an inlet formed near an outer side end of the fixed wrap, and one or more outlets formed near an inner side end of the fixed wrap, the fixed plate being exposed to a space that communicates with the one or more outlets;

an orbiting scroll having an orbiting plate, and an orbiting wrap that protrudes from the orbiting plate and engages with the fixed wrap, the orbiting wrap which forms a compression chamber having a suction chamber, an intermediate pressure chamber, and a discharge chamber, from an outer side to an inner side in a wrap moving direction together with the fixed plate, the fixed wrap, and the orbiting plate, while performing an orbiting motion with respect to the fixed wrap; and a discharge cover coupled to the fixed scroll, and configured to accommodate a refrigerant discharged through the outlet, wherein the fixed wrap is formed such that a wrap thickness thereof at a section which is adjacent to the inlet increases towards a virtual line which passes through a center of the fixed scroll and a suction end of the orbiting wrap which contacts an inner side surface of the fixed wrap.

9. The scroll compressor of claim 8, wherein at least one of an inner side surface or an outer side surface of the orbiting wrap within a range is formed as a curved line inversely-symmetric with a side surface of the fixed wrap corresponding thereto, based on a center line between the two wraps.

10. A scroll compressor, comprising:

a casing;

a drive motor provided at an inner space of the casing;

a rotational shaft coupled to a rotor of the drive motor, and rotated together with the rotor;

a fixed scroll having an inlet and an outlet, and having a fixed wrap;

an orbiting scroll having an orbiting wrap which forms a compression chamber including a suction chamber, an intermediate pressure chamber, and a discharge chamber, by being engaged with the fixed wrap, the orbiting scroll having a rotational shaft coupling portion to couple the rotational shaft in a penetrating manner; and a discharge cover coupled to a lower side of the fixed scroll, and configured to accommodate the outlet therein in order to guide a refrigerant discharged through the outlet to the inner space of the casing, wherein in a state in which the orbiting scroll and the fixed scroll are concentric with each other, a reinforcing portion is provided at at least one of an inner side surface or an outer side surface of the fixed wrap that is adjacent to the inlet, within a range of ±30° based on a virtual line which passes through a center of the fixed scroll and a suction end of the orbiting wrap which contacts an inner side surface of the fixed wrap, wherein a distance from the fixed wrap to the orbiting wrap within the range is the same as an orbiting radius of the orbiting scroll, wherein a wrap thickness of the fixed wrap within the range is formed to be thicker than a wrap thickness of the fixed wrap outside of the range, and wherein a wrap thickness of the orbiting wrap within the range is formed to be thinner than a wrap thickness of the orbiting wrap outside of the range.

11. The scroll compressor of claim 10, wherein the wrap thickness of the fixed wrap within the range gradually increases towards the virtual line.

12. The scroll compressor of claim 11, wherein at least one of an inner side surface or an outer side surface of the orbiting wrap within the range is formed as a curved line inversely-symmetric with a side surface of the fixed wrap corresponding thereto, based on a center line between the two wraps.

13. The scroll compressor of claim 10, further comprising:

a frame provided below the drive motor, wherein the fixed scroll is fixedly coupled to a bottom surface of the frame.

14. The scroll compressor of claim 13, wherein the orbiting scroll is provided between the frame and the fixed scroll.

15. The scroll compressor of claim 10, wherein the orbiting scroll is eccentrically coupled to the rotational shaft to perform an orbiting motion.

16. A scroll compressor, comprising:

an orbiting scroll having an orbiting wrap, and which performs an orbiting motion;

a fixed scroll having a fixed wrap to form a compression chamber including a suction chamber, an intermediate pressure chamber, and a discharge chamber, by being engaged with the orbiting wrap, an inlet formed near an outer side end of the fixed wrap, and one or more outlets formed near an inner side end of the fixed wrap; and a discharge covet coupled to the fixed scroll, and configured to accommodate a refrigerant discharged through the outlet, wherein a wrap thickness of the fixed wrap which is adjacent to the inlet is greater than a wrap thickness of the orbiting wrap within a range of ±30° based on a virtual line which passes through a center of the fixed scroll and a suction end of the orbiting wrap which contacts an inner side surface of the fixed wrap, and wherein at least one of an inner side surface or an outer side surface of the orbiting wrap within the range is formed as a curved line inversely-symmetric with a side surface of the fixed wrap corresponding thereto, based on a center line between the orbiting wrap and the fixed wrap.

17. The scroll compressor of claim 16, wherein a distance between the fixed wrap and the orbiting wrap within the range is equal to an orbiting radius of the orbiting scroll.

* * * * *